US007681477B2

(12) United States Patent
Alexander

(10) Patent No.: US 7,681,477 B2
(45) Date of Patent: Mar. 23, 2010

(54) ADJUSTABLE PLIERS

(75) Inventor: John Alexander, Sheffield (GB)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 12/010,976

(22) Filed: Jan. 31, 2008

(65) Prior Publication Data

US 2009/0193943 A1 Aug. 6, 2009

(51) Int. Cl.
*B25B 7/04* (2006.01)

(52) U.S. Cl. ..... 81/411; 81/385; 81/412; 81/413

(58) Field of Classification Search ..... 81/385, 81/411, 412, 413
See application file for complete search history.

(56) References Cited

U.S. PATENT DOCUMENTS

| | | | | |
|---|---|---|---|---|
| 1,472,312 | A | 10/1923 | Singer | |
| 1,867,912 | A | 7/1932 | Evey | |
| 2,600,512 | A | 6/1952 | Mead | |
| 2,884,061 | A | 4/1959 | Lee | |
| 4,748,876 | A | 6/1988 | Solf et al. | |
| 4,773,288 | A | 9/1988 | Jang et al. | |
| 4,893,530 | A * | 1/1990 | Warheit | 81/409.5 |
| D398,497 | S | 9/1998 | Gomas | |
| 6,199,459 | B1 | 3/2001 | Azkona | |
| 6,318,217 | B1 * | 11/2001 | Emhardt et al. | 81/411 |
| 6,341,545 | B1 | 1/2002 | Gomas | |
| 6,502,482 | B1 | 1/2003 | Putsch et al. | |
| 6,725,486 | B2 | 4/2004 | Oka | |
| 6,880,434 | B2 | 4/2005 | Nouvel | |
| 6,892,609 | B2 | 5/2005 | Kuo | |

(Continued)

FOREIGN PATENT DOCUMENTS

| | | |
|---|---|---|
| DE | 9109863 | 10/1991 |

(Continued)

OTHER PUBLICATIONS

European Search Report issued for EP Application No. 09151403.4, dated May 8, 2009.

*Primary Examiner*—Joseph J Hail, III
*Assistant Examiner*—Shantese McDonald
(74) *Attorney, Agent, or Firm*—PIllsbury Winthrop Shaw Pittman LLP

(57) ABSTRACT

The present invention discloses pliers including first and second members having first and second jaw members, respectively, and a first handle and a second handle. The jaws have first and second workpiece engaging surfaces constructed and arranged to generally correspond to first and second surfaces of a standardized workpiece, such as a hexagonal nut. A pivot assembly is provided to interact between the first and second members, which includes a plurality of pivot retaining regions disposed on the first jaw member and a pivot structure disposed within the second member. The pivot structure is engageable at a selected one of the retaining regions to adjust a relative position of a pivot axis between the first and second members so as to adjust an extent of relative spacing between the first and second jaws of the pliers. The second member and the pivot structure are capable of relative movement with respect to one another so that the first workpiece engaging surfaces and the second workpiece engaging surfaces orient themselves into engagement with the first and second surfaces of the standardized workpiece, respectively.

24 Claims, 8 Drawing Sheets

U.S. PATENT DOCUMENTS

| | | | | |
|---|---|---|---|---|
| 7,017,458 | B2 | 3/2006 | Poole et al. | |
| 7,044,033 | B2 | 5/2006 | Hirse | |
| 7,146,888 | B2 | 12/2006 | Martinka | |
| 7,174,816 | B1 | 2/2007 | Di Bitonto et al. | |
| 7,182,004 | B1 | 2/2007 | Wang | |
| 7,191,688 | B1 * | 3/2007 | Hall, Jr. ..... | 81/411 |
| 2006/0107800 | A1 | 5/2006 | Dallas et al. | |
| 2006/0243103 | A1 | 11/2006 | Engvall et al. | |
| 2007/0044601 | A1 | 3/2007 | Wang | |

FOREIGN PATENT DOCUMENTS

| | | |
|---|---|---|
| FR | 1576362 | 8/1969 |

* cited by examiner

ADJUSTABLE PLIERS

BACKGROUND OF THE INVENTION

1. Field of Invention

The present invention is generally related to pliers. More specifically, the present invention is related to adjustable pliers.

2. Background

Pliers are a tool that may be used on a wide range of workpieces. Some pliers may be presented with an ill-fitting geometry between the jaws of the pliers and the workpiece, thus causing stripping of the workpiece or forming blemishes on the workpiece.

SUMMARY OF THE INVENTION

One aspect of the invention provides pliers includes a first member having a first jaw member and a first handle and a second member having a second jaw member and a second handle. The first jaw has first workpiece engaging surfaces constructed and arranged to engage first surfaces of a standardized workpiece and the second jaw has second workpiece engaging surfaces constructed and arranged to engage second surfaces of the standardized workpiece. A pivot assembly is provided to interact between the first and second members. The pivot assembly includes a plurality of pivot retaining regions disposed on the first jaw member and a pivot structure disposed on the second member. The pivot structure is engageable at a selected one of the retaining regions to adjust a relative position of a pivot axis between the first and second members so as to adjust an extent of relative spacing between the first and second jaws of the pliers. The second member and the pivot structure are capable of relative movement with respect to one another so that the first workpiece engaging surfaces and the second workpiece engaging surfaces orient themselves into engagement with the first and second surfaces of the standardized workpiece, respectively.

In another aspect of the invention, the pivot structure includes a slider body on which the pivot pin is mounted. In an aspect of the invention, the first member includes a slot, and the slider body is slidably movable within the slot.

In an aspect of the invention, the retaining regions include opposing arcuate surfaces. In an aspect of the invention, the pivot pin includes an arcuate pin surface constructed and arranged to engage the opposing arcuate surfaces of the selected retaining region, and a cut out region which enables at least one of the opposing arcuate surfaces to disengage from the arcuate pin surface to enable the pivot assembly to be moved to a different selected retaining region.

In an aspect of the invention, the relative movement of the pliers occurs upon application of a force to the first and second members.

An aspect of the invention provides a method of operating pliers. The pliers have a first member with pivot retaining regions and a second member with a pivot structure slidably engaged therewith. The first and second member have workpiece engaging surfaces that generally correspond to surfaces of a standard workpiece. When using the pliers the first member and/or the second member are relatively moved relative to the other so as to select a pivot retaining region to engage with the pivot structure. The first member and/or the second member are then pivot relative to the other about the pivot structure engaged with the pivot retaining region. The method also includes engaging a workpiece with the first and the second members and sliding the workpiece engaging surfaces into engagement with the corresponding surfaces of a workpiece.

The pivot structure is then slid relative to the second member to enable the workpiece engaging surfaces to matingly engage with the corresponding surfaces of the workpiece.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

Figure 1:
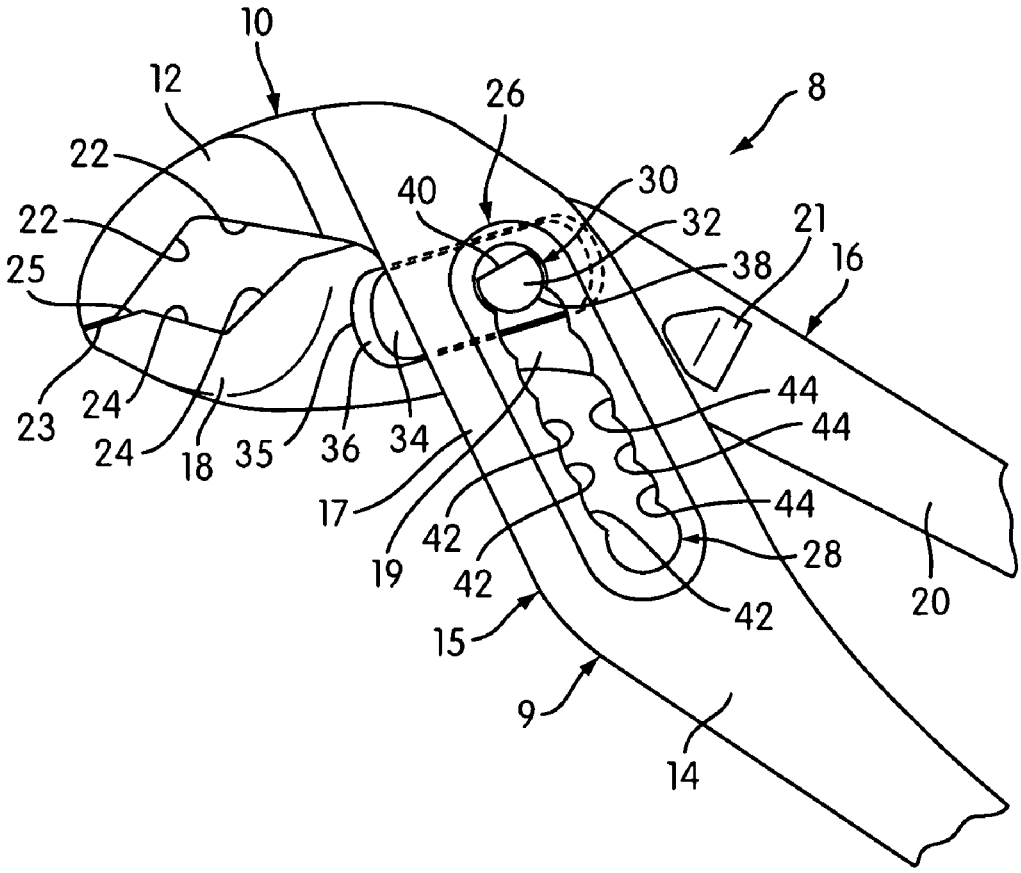
FIG. 1 shows a first side view of pliers in accordance with an embodiment of the present invention.
Figure 7:
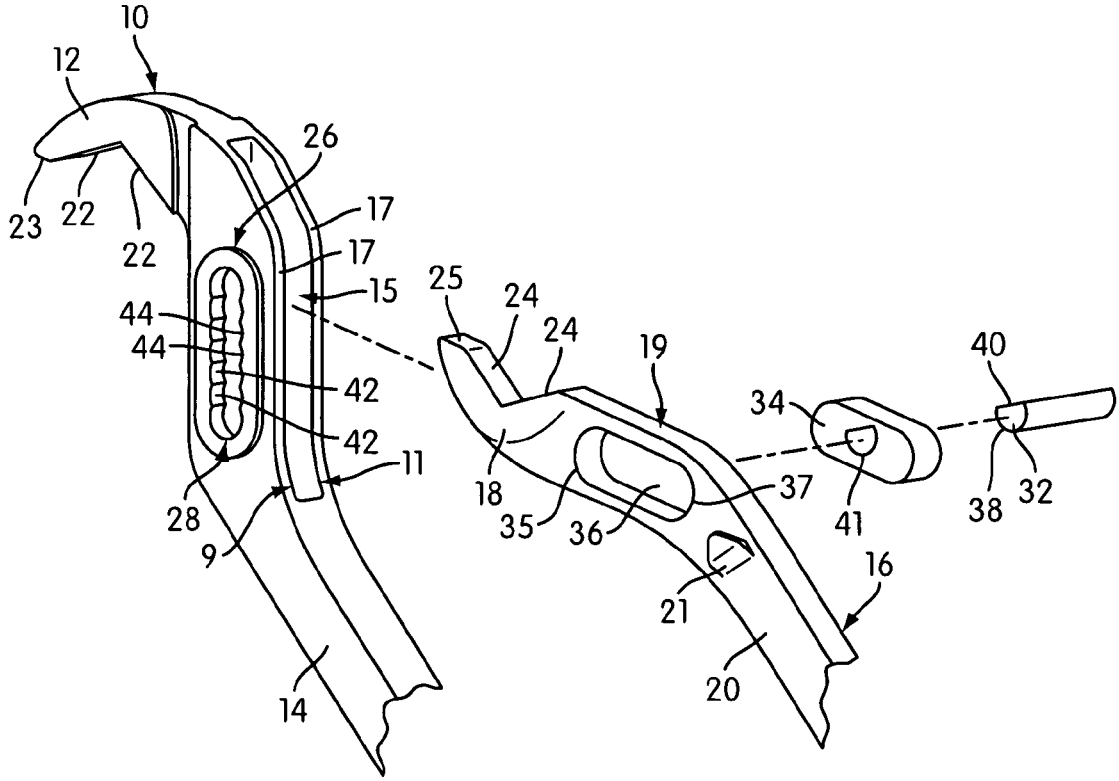
FIG. 7 illustrates a perspective or exploded view of the assembly of the pliers as shown in FIGS. 1-5.

FIG. 1 shows a first side view of pliers 8 in accordance with an embodiment of the present invention. Pliers 8 comprise a first member 10 having a first jaw member 12 and a first handle 14, and a second member 16 having a second jaw member 18 and a second handle 20. In an embodiment, the first member 10 and second member 16 are connected via a pivot connection. For example, as can be appreciated from FIGS. 1 and 7, shows the second member 16 is received within spaced walls 17 of the first member 10. The first member 10 comprises an opening 15 between spaced walls 17 (e.g., see FIG. 7) for receiving a neck portion 19 of the second member 16 therethrough. Additional details regarding the assembly and connection of the first member 10 and the second member 16 are further described below with reference to FIG. 7.

As shown in FIG. 1, the first jaw 12 has first workpiece engaging surfaces 22, 23 and second jaw 18 has second workpiece engaging surfaces 24, 25. The engaging surfaces 22 and 24 are designed such that they are shaped and can be oriented with respect to one another so that they correspond to surfaces of a standardized workpiece, as will be further described with reference to FIG. 5. As shown in the illustrated embodiment, the workpiece engaging surface 25 of second jaw 18 may have a greater length and/or surface area as compared to the engaging surface 23 of the first jaw 12. However, other shapes and sizes of the surfaces 22, 23 and 24, 25 may be provided, as discussed herein.

Pliers 8 also comprise a pivot assembly 26 that interacts between the first and second members 10, 16. The pivot assembly 26 includes a plurality of pivot retaining regions 28 disposed on the first member 10. More specifically, the retaining regions 28 are provided on both side walls 17 of the first member 10, with opening 15 therebetween (e.g., see also FIGS. 2 and 7). The pivot assembly 26 also includes a pivot structure 30 disposed between the first and second members 10, 16. In one embodiment, the pivot structure 30 is a floating pivot structure carried within a slot 36 on or within the second member 16. The floating pivot structure 30 may be engaged at a selected one of the retaining regions 28 on the first member 10, as illustrated by comparing FIGS. 1 and 3.

Figure 3:
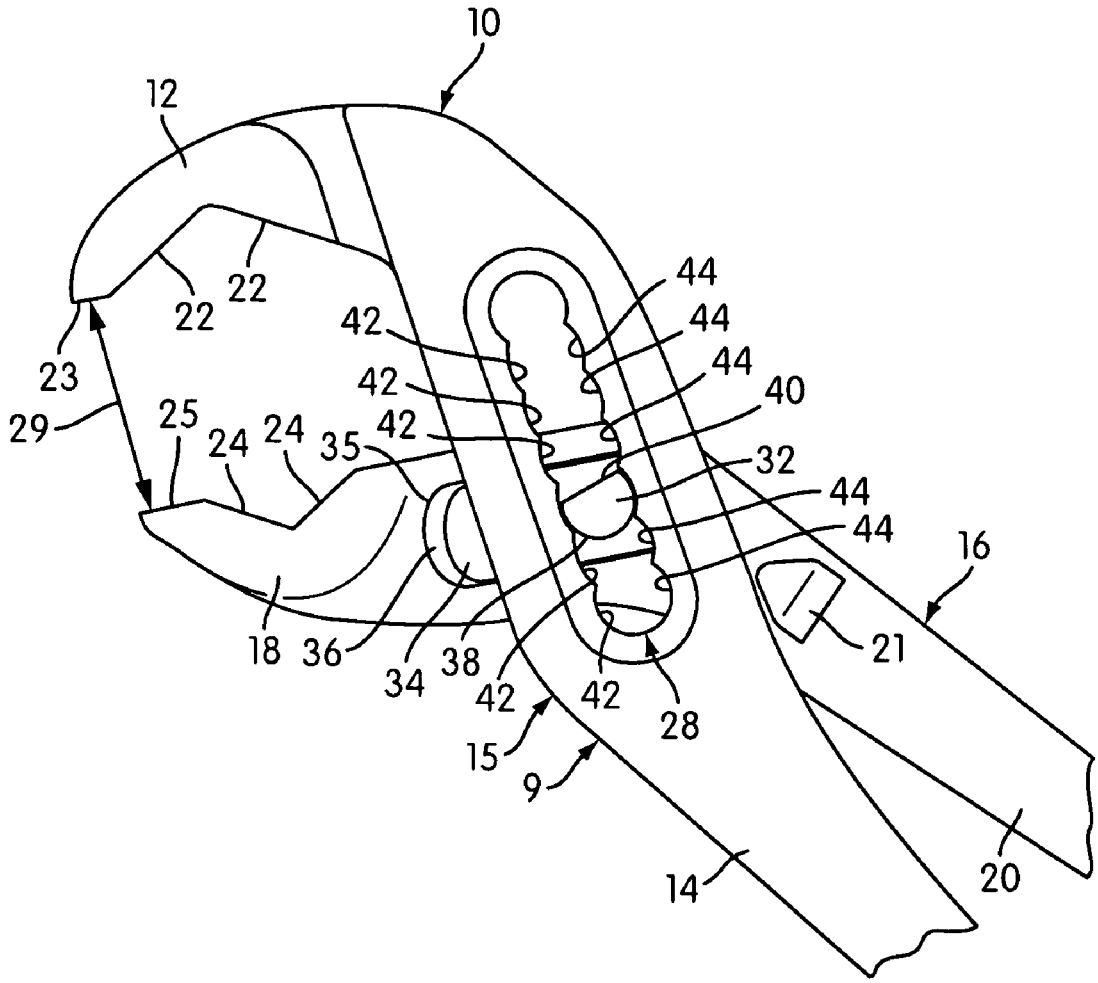
FIG. 3 shows the first side of the pliers of FIG. 1, illustrating a relatively lower position of a pivot axis of the pliers in accordance with an embodiment of the present invention.

In an embodiment, the floating pivot structure 30 comprises a pivot pin 32 and a slider body 34. The pivot pin 32 is fixed relative to slider body 34 in a receiving opening 41 of the slider body 34 (e.g., see FIG. 7). The pin 32 selectively engages within a selected one of the retaining regions 28. In an embodiment, each of the retaining regions 28 comprises opposing arcuate surfaces 42 and 44, as shown in FIGS. 1 and 3, for example. Engaging the pivot structure 30 at or within one of the selected retaining regions 28 adjusts a relative positioning of a pivot axis between the first and second member 10, 16, thus adjusting an extent 29 or length (see FIG. 3) of relative minimum spacing between the end surfaces 23 and 25 of the first and second members 10, 16, respectively.

The Figures also show that second jaw 18 comprises the aforementioned elongated slot 36. The elongated slot 36 comprises a front end 35 and a back end 37 (e.g., see FIGS. 4*a* and 4*b*). In an embodiment, the slider body 34 is slidably movable within the elongated slot 36. The slider body 34 may be of an elongated shape that generally corresponds to the shape of elongated slot 36 (for example, both have arcuate end surfaces and parallel intermediate surfaces), although slot 36 is longer than body 34. The length of the slider body 34 is sized such that it is smaller than the elongated slot so that when slider body 34 is engaged within the slot 36, the slider body 34 is capable of relative movement (e.g., forward and backward) within or with respect to the slot 36. The floating pivot structure 30 is held or trapped between the walls 17 of the first member 10.

In an embodiment, the pivot pin 32 of the floating pivot structure 30 is formed as a partial cylinder that has an arcuate (partial cylinder) pin surface 38 that is constructed and arranged to engage the opposing arcuate surfaces 42 and 44 of the selected retaining region 28. In an embodiment, pivot pin 32 comprises a cut out region 40 (or flat region) which enables at least one of the opposing arcuate surfaces 42 and/or 44 of retaining regions 28 to disengage from the arcuate pin surface 38 and to enable the pivot assembly 26 to be moved to a different selected retaining region 28.

Slider body 34 may be used to move the second member 16 and the pivot axis defined by pivot pin 32 relative to one another. In the illustrated embodiment, the pivot structure 30 comprises a slider body 34 on which the pivot pin 32 is mounted, although it should be appreciated that other configurations for the pivot structure define an adjustable pivot axis. Specifically, all that is required for the pivot structure 30 is that it provides a pivot axis that is movable relative to the second member 16 (or second member 16 may be considered movable relative to the pivot structure 30 and the pivot axis) and that can be selectively fixed at a selected position relative to the first member 10. The slider body 34 is slidably movable within the slot 36 (or slot 36 can be considered movable relative to slider body 34). Thus, the second member 16 and the pivot pin 32 move relative to each other via the slider body 34.

In an embodiment, the second member 16 may also include a stop member 21. Stop member 21 may be used to limit the movement of the first and second handles 14 and 20 when they are squeezed, for example, so as to reduce the potential for injuring the user. However, the slider body 34 of the floating pivot structure 30 is designed such that it also generally assists in limiting the movement of the handles 14, 20. Thus, the stop member 21 is optional and need not be required.

Figure 6:
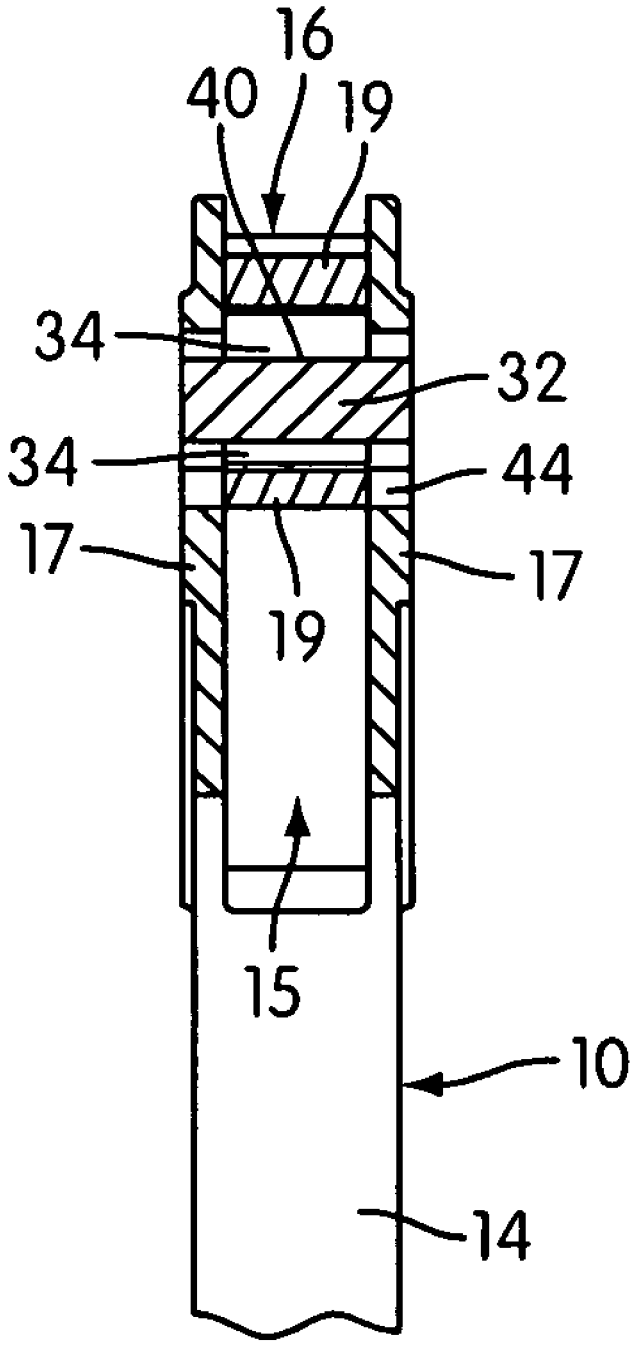
FIG. 6 illustrates a cross-sectional view of the pliers taken through the line 6-6 in FIG. 4*a*.

The cross-sectional view of FIG. 6 and the exploded view of FIG. 7 illustrate the assembly or connection of the first and second members 10, 16 in accordance with one embodiment. As shown, the opening 15 is provided between spaced walls 17 in first member 10 for receiving at least the neck portion 19 of the second member 16 therethrough. Second member 16 includes slot 36 for receiving the slider body 34 and the pivot pin 32 fixed to or in the slider body 34.

To assemble the pliers 8, the slider body 34 is insert into the slot 36 of the second member 16. The jaw member 18 of the second member 16 is then insert through the opening 15 of the first member 10. When the second member 16 is insert through the opening 15, the opening 41 of the slider body 34 is aligned between and with the retaining regions 28, such that the pivot pin 32 may then be insert through the retaining regions 28 and receiving opening 41. The pin 32 is insert such that the opposite ends of the pin 32 extend sufficiently outwards on opposite sides of slider body 34 so that they can engage with the retaining regions 28 on both sides 9 and 11 (on side walls 17) of the first member 10. The pin 32 is then welded, adhered, fastened, pinned, or otherwise fixed in place relative to the slider 34.

Although the first member 10 and second member 16 are shown as being attached using a floating pivot connection, the attachment or connecting methods should not be limiting. For example, in an embodiment, no opening 15 is provided in the first member 10. Instead, the first and second members 10, 16 may be attached using flanges. For example, the first and second members 10, 16 may be joined using a groove-joint construction. That is, the first and second members 10, 16 would be assembled such that the first member 10 is disposed on top of the second member 16. The slider body 34 may comprise an enlarged flange on the outside thereof that is at least slightly larger in dimension than slot 36 so as to assist in holding the slider body within the slot when assembled. Also, the pivot pin 32 may be attached on one side of the slider 34 on a side of slider 34 opposite the enlarged flange. The end of the pin 32 opposite the slider 34 may similarly comprise a flange that is larger than the retaining regions of the pivot assembly so as to assist in holding the pin within the slots and the first and second members 10, 16 together. Thus, the enlarged flange on the slider 34 and the enlarged flange on the pin 32 would serve to retain the two members 10, 16 to one other.

Figure 4A:
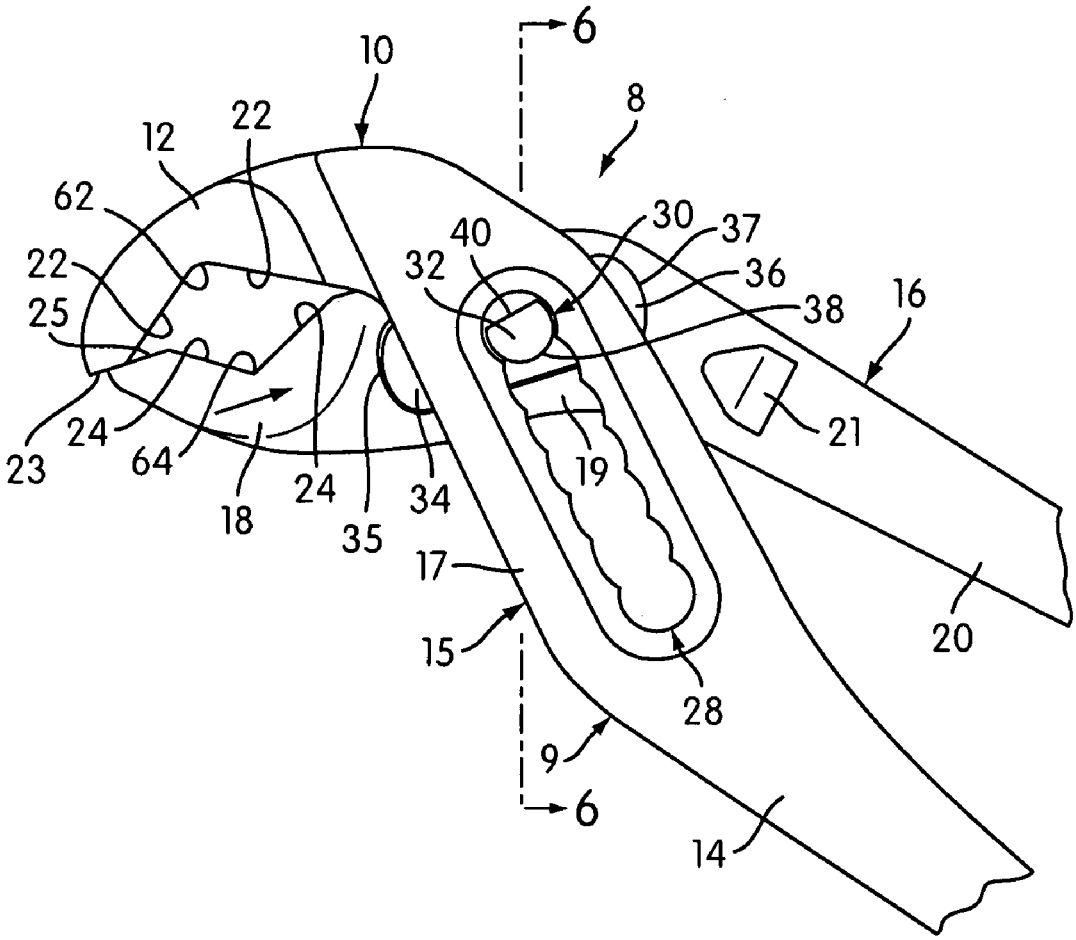
FIG. 4*a* shows the first side view of the second jaw of the pliers of FIG. 1, with the lower jaw in a retracted or rearward position in accordance with an embodiment of the present invention.
Figure 4B:
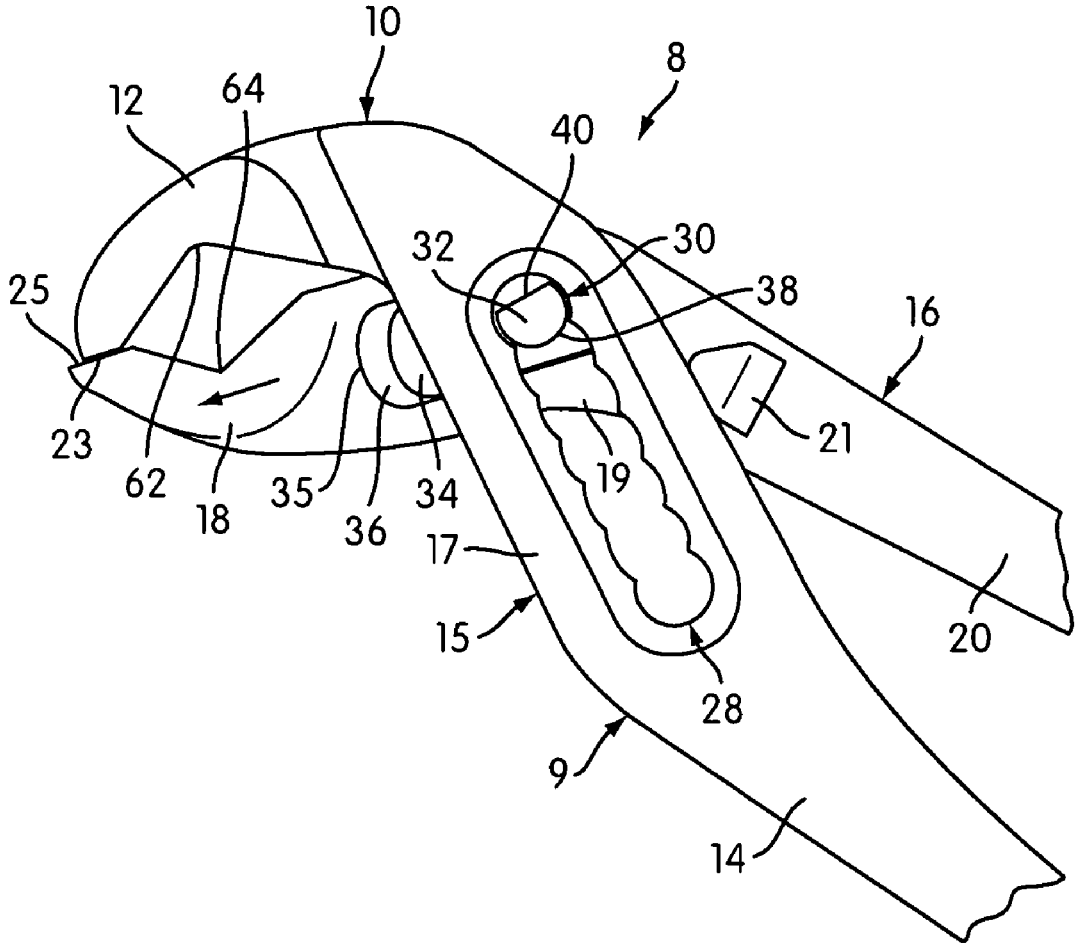
FIG. 4*b* shows the first side view of the second jaw of the pliers of FIG. 1, with the lower jaw in an extended or forward position in accordance with an embodiment of the present invention.
Figure 5:
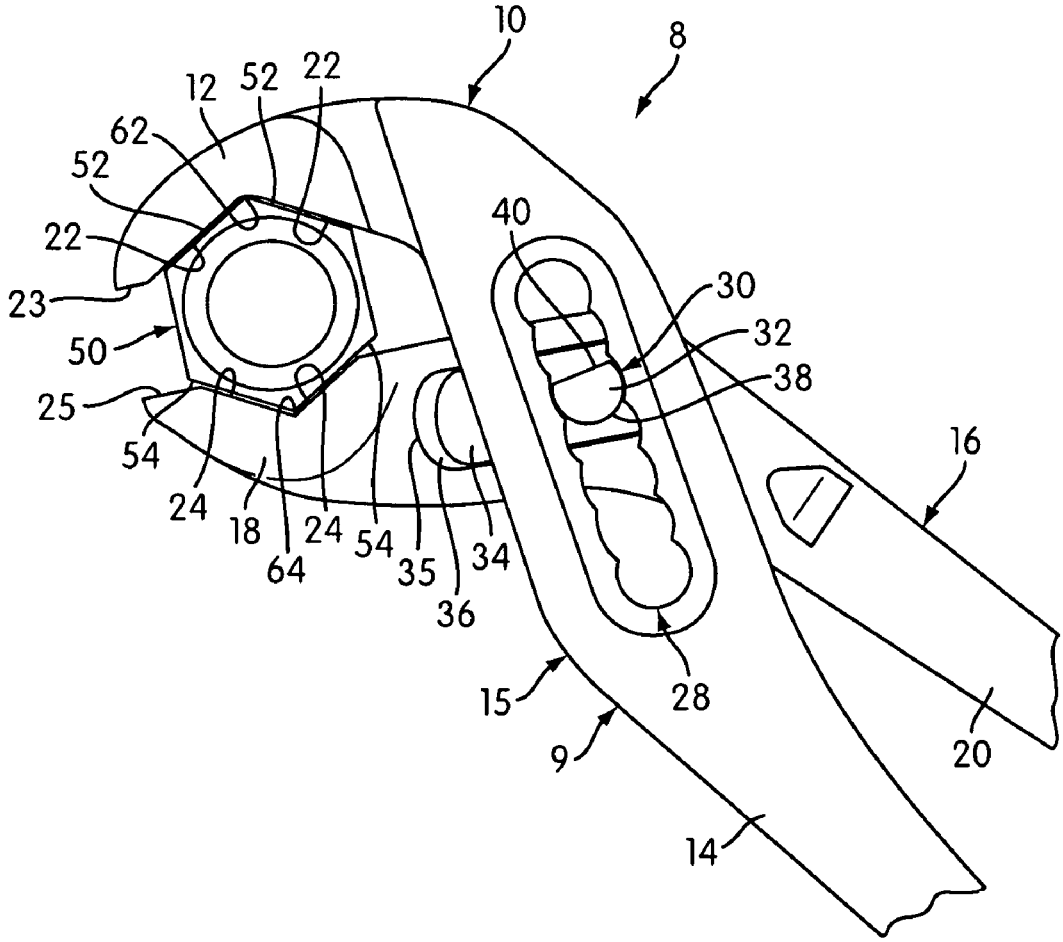
FIG. 5 shows the first side view of the pliers of FIG. 1 as applied to a hexagonal nut which comprises a standardized workpiece in accordance with an embodiment of the present invention.

FIGS. 4*a* and 4*b* show a side view of the second jaw 18 of the pliers 8 of FIG. 1 adjusted in a first and second position, respectfully, in accordance with an embodiment of the present invention. As previously noted, the second member 16 and the pivot structure 30 are capable of relative movement with respect to one another, so that the first workpiece engaging surfaces 22 and the second workpiece engaging surfaces 24 self-orient themselves into engagement with the first and second surfaces of the standardized workpiece, respectively, when the pliers handles 14, 20 are squeezed (e.g., to move the handles toward one other). In an embodiment, the slider body 34 slides within slot 36 until the corners or points of the workpiece find their way (e.g., by sliding) into the corresponding recessed points 62, 64 (e.g., see also FIG. 5) in the upper and lower jaws, respectively. That is, as force is applied to squeeze the pliers handles toward one another, the workpiece surfaces provide a camming action to at least one of the workpiece engaging surfaces 22 and/or 24, so that at least one surface 22 and/or 24 slides along the adjacent workpiece surface and moves the associated first member 10 and/or second member 16 relative to the other until brought to rest when surfaces are engaged, as illustrated in FIG. 5. During this camming action, there is relative movement between pivot structure 30 and second member 16, as slider body 34 moves in slot 36.

It should be appreciated that in the embodiment shown, the workpiece engaging surfaces 22 comprise a pair of surface portions that form a 120° angle with respect to one another. Similarly, the workpiece engaging surfaces 24 comprise a pair of surface portions that for a 120° angle with respect to one another. However, it is not necessary for these surface portions to be continuous, or to join one another at the points 62, 64, as a discontinuous surface configuration (e.g., corner portions 62, 64 are deep recessed that do not contact the workpiece corners) can provide a similar camming action in some embodiments. It is also unnecessary for surfaces 22 or 24 to be planar. For example, in one embodiment, convex surfaces may be provided. Thus, depending on the orientation of the standardized workpiece, the second jaw 18 of second member 16 may move rearwardly, as shown in FIG. 4*a*, by the slider body 34 moving in a relative forward direction relative to the slot 36 towards a front end 35 of the slot 36. The second jaw 18 of the second member 16 may alternatively move forwardly, as shown FIG. 4*b*, with respect to the pivot structure 30, by the slider body 34 moving in an opposite or reverse or rearward direction within the slot 36 towards the back end 37 of the slot 36.

In an embodiment, the first workpiece engaging surfaces 22 comprise substantially flat surfaces disposed at a 120 degree angle. In an embodiment, the second workpiece engaging surfaces 24 comprise flat, smooth surfaces disposed at a 120 degree angle to enable the surfaces 22 and 24 to closely conform to the surfaces of a standardized workpiece in the form of a hexagonal nut. While the surfaces 22 and 24 may be planar, as noted previously, the surfaces 22 and 24 need not be planar.

FIG. 5 shows the pliers 8 of FIG. 1 as applied to a hexagonal nut 50 in accordance with an embodiment of the present invention. In the embodiment, the first and second workpiece engaging surfaces 22, 24 are constructed and arranged to matingly engage the first surfaces 52 and the second surfaces 54 of the hexagonal nut 50. More specifically, to use the pliers 8 on the 50 shown in FIG. 5, a user may first adjust the extent of the jaws 12, 18 in relation to each other by moving the pivot pin 32 of the pivot structure 30 within the retaining regions 28 of the first member 10 such that a selected increment suits the size (e.g., diameter) of the nut 50 being gripped. The user may then apply a force to first and second handles 14 and 20. During application of the force to the handles 14, 20, the first workpiece engaging surfaces 22 are aligned and engaged with the first surfaces 52 of the nut 50. The second workpiece engaging surfaces 24 may be aligned such that they engage the second surfaces 54 of the nut 50 through the relative translational or sliding movement of the slider body and slot as previously described in FIGS. 4*a* and 4*b*. In one embodiment, slider body 34 slides within slot 36 until the corners or points of the first and second surfaces 52, 54 of the nut 50 find their way into the corresponding recessed points 62, 64. The pivot structure 30 and (bating pivot pin 32 assist in allowing the jaws 12, 18 to be accurately aligned with the hexagonal form of the nut 50 upon application of force or pressure to the handles 14, 20. Such alignment ensures a more optimum grip of the nut 50 (or other workpiece) and freedom from slippage. It should be appreciated that the invention can accommodate or be adapted for use with other standardized workpieces other than hexagonal nuts, by changing the shape or size or angle of the surfaces 22 and/or 24.

Figure 2:
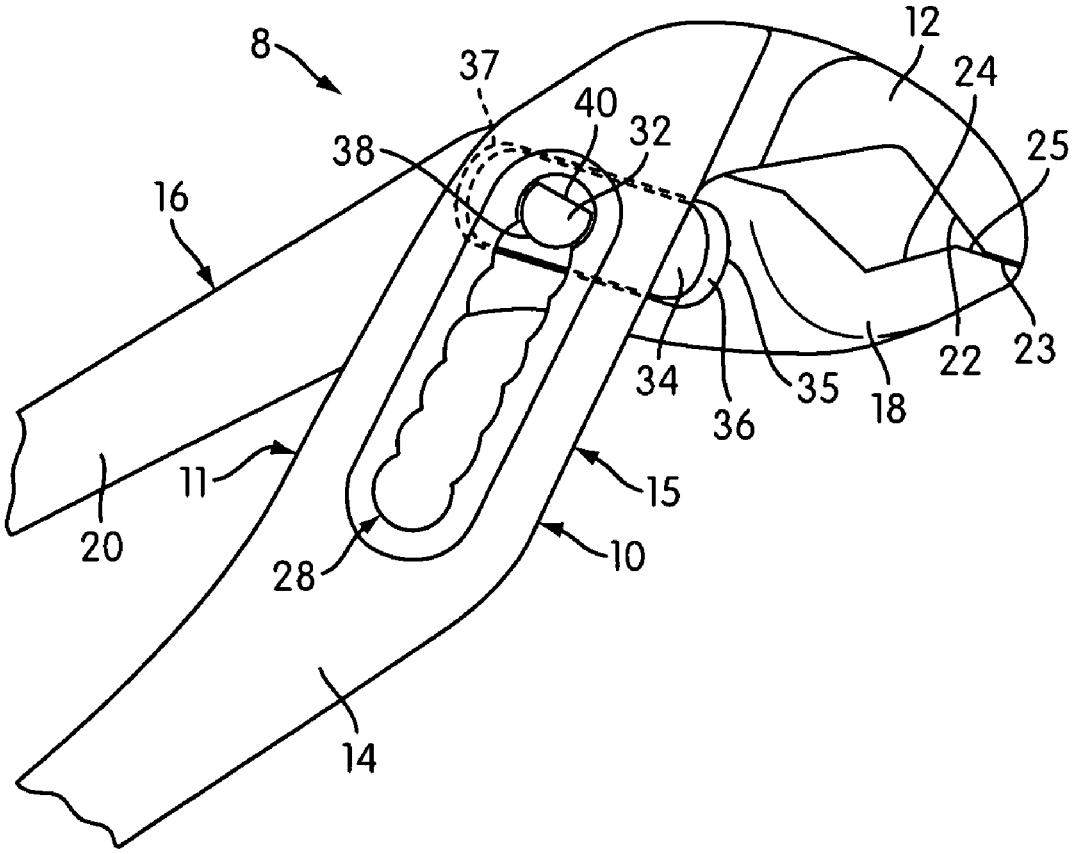
FIG. 2 show a second side view of the pliers opposite from the side shown in FIG. 1.

In an embodiment, the pivot structure 30 may be biased by a biasing member (not shown) to retain the second member 16 in a predetermined position relative to the pivot structure 30 until application of the force. For example, as shown in FIG. 2, the second member 16 and pivot structure 30 may be retained in a "neutral" or "rest" position, such that movement may occur in either direction (forward or rearward) upon application of a force to the handles 14, 20 of the pliers 8. In an embodiment, the biasing member is a resilient mechanism or a spring (not shown).

In an embodiment, the engaging surfaces 22 or 24 of the first jaw 12 or second jaw 18, respectively, are substantially smooth. In an embodiment, the engaging surfaces 22 or 24 of the first jaw 12 or the second jaw 18 may be at least partially smooth. The use of a smooth engaging surface may, for example, also assist in preventing marring or nicking of a standardized workpiece. In an embodiment, the engaging surfaces 22 or 24 may also comprise teeth along the surfaces thereof.

In an embodiment, the engaging surfaces 23 or 25 may be used to grip the first and second surfaces 52, 54 of the nut 50. In an embodiment, the engaging surfaces 23 or 25 of the first jaw 12 or second jaw 18, respectively, are substantially smooth. In an embodiment, the engaging surfaces 23 or 25 of the first jaw 12 or the second jaw 18 may be at least partially smooth. In an embodiment, the engaging surfaces 23 or 25 may also comprise teeth along the surfaces thereof. In an embodiment, the length of engaging surfaces 25 may be larger than engaging surfaces 23, for example, such that upon adjustment using slider body 34, the surfaces 23, 25 may still come in contact with one another (e.g., see FIGS. 4*a* and 4*b*).

While the principles of the invention have been made clear in the illustrative embodiments set forth above, it will be apparent to those skilled in the art that various modifications may be made to the structure, arrangement, proportion, elements, materials, and components used in the practice of the invention. For example, in an embodiment, the retaining regions 28 and the pivot structure 30 may comprise a tongue and groove configuration (not shown). For example, the retaining regions may be in the form of grooves in the first handle 14 of first member 10, and the pivot structure may comprise a tongue or extended structure for selectively being received in the grooves. In an embodiment, the shape of the retaining regions 28, pivot pin 32, and/or tongue and/or grooves may be of an arcuate or oblong shape. Thus, a user may open or extend the extent of the jaws 12, 18 of the pliers 8 using any known configuration and should not be limited to those described.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. Pliers comprising:

a first member having a first jaw member and a first handle;

a second member having a second jaw member and a second handle;

the first jaw having first workpiece engaging surfaces;

the second jaw having second workpiece engaging surfaces;

a pivot assembly interacting between the first and second members, the pivot assembly including a plurality of pivot retaining regions disposed on the first member and a pivot structure engaged with the second member, the pivot structure being engageable at a selected one of the retaining regions to adjust a relative positioning of a pivot axis between the first and second members so as to adjust an extent of relative spacing between the first and second jaws;

wherein with the pivot structure engaged at the selected one of the retaining regions, a) the first member and the second member are capable of relative pivotal movement about the pivot axis, and b) the pivot axis is moveable relative to the second member to enable relative translational movement between the first jaw and the second jaw so that the first workpiece engaging surfaces and the second workpiece engaging surfaces orient themselves into engagement with first and second surfaces of a standardized workpiece, respectively.

2. Pliers according claim 1, wherein the first workpiece engaging surfaces comprise substantially flat surfaces disposed at approximately a 120° angle, and wherein the second workpiece engaging surfaces comprise flat surfaces disposed at approximately a 120° angle.

3. Pliers according to claim 2, wherein the first and second workpiece engaging surfaces are constructed and arranged to engage the first and second surfaces of a hexagonal nut, which comprises the standardized workpiece.

4. Pliers according to claim 1, wherein the pivot structure comprises a pivot pin that selectively engages the retaining regions.

5. Pliers according to claim 4, wherein the pivot structure further comprises a slider body on which the pivot pin is mounted.

6. Pliers according to claim 5, wherein the second member comprises a slot, and wherein the slider body is slidably movable within the slot.

7. Pliers according to claim 4, wherein the retaining regions each comprise opposing arcuate surfaces.

8. Pliers according to claim 7, wherein the pivot pin comprises an arcuate pin surface constructed and arranged to engage the opposing arcuate surfaces of the selected retaining region, and a cut out region which enables at least one of the opposing arcuate surfaces to disengage from the arcuate pin surface to enable the pivot assembly to be moved to a different selected retaining region.

9. Pliers according to claim 1, wherein the first member comprises a first side, a second side, and an opening therebetween to receive at least a part of the second member therethrough.

10. Pliers according to claim 9, wherein the retaining regions are provided on the first side and the second side of the first member.

11. Pliers according to claim 1, wherein the relative translational movement occurs upon application of a force to the first and second members.

12. Pliers according to claim 1, wherein the relative translational movement results in extending or retracting the second jaw relative to the first jaw.

13. Pliers according to claim 1, wherein the engaging surfaces of the first jaw and second jaw are substantially smooth.

14. The pliers according to claim 1, wherein the first workpiece engaging surfaces generally correspond in configuration to the first surfaces of the standardized workpiece, and the second workpiece engaging surfaces generally correspond to the second surfaces of the standardized workpiece.

15. A method of operating pliers, wherein the pliers comprise a first member with pivot retaining regions, a second member with a pivot structure slidably engaged therewith, the first and second member having workpiece engaging surfaces generally corresponding to surfaces of a standard workpiece, the method comprising:

relatively moving the first member and/or the second member relative to the other so as to select a pivot retaining region to engage with the pivot structure;

pivoting the first member and/or the second member relative to the other about the pivot structure engaged with the pivot retaining region;

engaging a workpiece with the first and the second members;

sliding the workpiece engaging surfaces into engagement with the corresponding surfaces of a workpiece; and sliding the pivot structure relative to the second member while the pivot structure is engaged with the pivot retaining region to enable the workpiece engaging surfaces to matingly engage with the corresponding surfaces of the workpiece.

16. A method according to claim 15, wherein the workpiece engaging surfaces comprise substantially flat surfaces disposed at approximately a 120° angle.

17. A method according to claim 15, wherein the standardized workpiece is a hexagonal nut.

18. A method according to claim 15, wherein the pivot structure comprises a pivot pin that selectively engages the retaining regions.

19. A method according to claim 15, wherein the pivot structure further comprises a slider body on which the pivot pin is mounted.

20. A method according to claim 19, wherein the second member comprises a slot, and wherein the slider body is slidably movable within the slot to move the pivot structure relative to the second member.

21. A method according to claim 15, wherein the relative sliding occurs upon application of a force to the first and second members.

22. A method according to claim 15, wherein the relative sliding results in extending or retracting the second jaw relative to the first jaw.

23. Pliers comprising:

a first member having a first jaw member and a first handle;

a second member having a second jaw member and a second handle;

the first jaw having first workpiece engaging surfaces;

the second jaw having second workpiece engaging surfaces;

a pivot assembly interacting between the first and second members, the pivot assembly comprising a pivot structure about which the first and second members are capable of relative pivotal movement, wherein the pivot structure being selectively fixed at a selective pivot axis, the pivot structure being slidable relative to the second member to permit for relative forward-rearward movement between the first jaw and the second jaw while the first and second jaws first contact a workpiece so that the first workpiece engaging surfaces and the second workpiece engaging surfaces orient themselves into engagement with the first and second surfaces of the standardized workpiece.

24. The pliers according to claim 23, wherein the first workpiece engaging surfaces generally correspond in configuration to the first surfaces of the standardized workpiece, and the second workpiece engaging surfaces generally correspond to the second surfaces of the standardized workpiece.

* * * * *